US005526106A

United States Patent [19]

Katsumi et al.

[11] Patent Number: 5,526,106

[45] Date of Patent: Jun. 11, 1996

[54] IMAGE FORMING APPARATUS WITH TRANSFER MATERIAL SEPARATING MEANS

[75] Inventors: Toru Katsumi, Yokohama; Nobuyuki Itoh, Kawasaki; Hiroaki Tsuchiya, Yokohama, all of Japan

[73] Assignee: Canon Kabushiki Kaisha, Tokyo, Japan

[21] Appl. No.: 396,072

[22] Filed: Feb. 28, 1995

Related U.S. Application Data

[63] Continuation of Ser. No. 72,865, Jun. 7, 1993, abandoned, which is a continuation of Ser. No. 351,081, May 12, 1989, abandoned.

[30] Foreign Application Priority Data

| | | | |
|---|---|---|---|
| May 20, 1988 | [JP] | Japan | 63-121951 |
| May 16, 1988 | [JP] | Japan | 63-116911 |
| May 16, 1988 | [JP] | Japan | 63-116912 |
| May 19, 1988 | [JP] | Japan | 63-120752 |

[51] Int. Cl.[6] ..... G03G 21/00

[52] U.S. Cl. ..... 355/315; 271/307

[58] Field of Search ..... 355/225, 272, 355/274, 315; 271/307, 308, 310, 900

[56] References Cited

U.S. PATENT DOCUMENTS

| | | | |
|---|---|---|---|
| 3,970,381 | 7/1976 | Meagher et al. | 271/900 X |
| 4,286,862 | 9/1981 | Akita et al. | 355/315 |
| 4,341,457 | 7/1982 | Nakahata et al. | 355/274 |
| 4,408,863 | 10/1983 | Ogata et al. | 271/310 X |
| 4,482,240 | 11/1984 | Kuge et al. | 355/315 X |
| 4,672,505 | 6/1987 | Tsuchiya et al. | 361/235 |
| 4,728,991 | 3/1988 | Takayama et al. | 355/206 X |
| 4,876,578 | 10/1989 | Hara et al. | 355/315 |
| 4,896,192 | 1/1990 | Kinoshita | 355/315 |
| 4,974,032 | 11/1990 | Hara et al. | 355/315 |

FOREIGN PATENT DOCUMENTS

| | | |
|---|---|---|
| 58-120282 | 7/1983 | Japan . |
| 60-220381 | 11/1985 | Japan . |
| 61-026068 | 2/1986 | Japan . |
| 61-159678 | 7/1986 | Japan . |
| 62-043681 | 2/1987 | Japan . |
| 63-286876 | 11/1988 | Japan . |

*Primary Examiner*—Fred L. Braun

*Attorney, Agent, or Firm*—Fitzpatrick, Cella, Harper & Scinto

[57] ABSTRACT

An image forming apparatus is provided with a movable image bearing member, such as a movable amorphous silicon photosensitive member, and an image forming member forms an image on a surface of the image bearing member. The image on the surface of the photosensitive member is transferred to a transfer material. A separator electrostatically separates the transfer material from the photosensitive member after the image is transferred by the transferring member. The separator is supplied with an electric power having a voltage of a waveform which periodically changes. In one embodiment, the voltage waveform includes at least two sine waves of different frequencies superposed to lower the peak value of the first sine wave.

30 Claims, 11 Drawing Sheets

IMAGE FORMING APPARATUS WITH TRANSFER MATERIAL SEPARATING MEANS

This application is a continuation of application Ser. No. 08/072,865 filed Jun. 7, 1993, now abandoned which application is a continuation of application Ser. No. 07/351,081 filed May 12, 1989, now abandoned.

FIELD OF THE INVENTION AND RELATED ART

The present invention relates to an image forming apparatus such as an electrophotographic copying machine and an electrophotographic printer, using an electrostatic image transfer process. More particularly the present invention relates to an image forming apparatus having transfer material separating means for electrostatically separating the transfer material from an image bearing member.

In a known image forming apparatus performing an electrostatic process including a step of electrostatically transferring, onto a transfer material in the form of a sheet of paper, for example, a transferable toner image formed on the surface of the image bearing member, the transfer material tends to be electrostatically attracted to the image bearing member as a result of the image transfer operation which applies electric charge to the transfer material. Therefore, it is required that the transfer material be positively separated from the image bearing member.

It is also known that a separation discharger, as the transfer material separating means, is disposed at a position after the image transfer position to apply electric charge having the polarity opposite to that applied to the transfer material, thus neutralizing or discharging the electric charge applied during the transfer operation, by which the attraction of the transfer material to the image bearing member is reduced. The electrostatic separating means of this type is known as providing substantial effects.

In the separation discharger of this type, it is usual that the discharge is effected with a corona discharge provided by a superposed AC and DC voltage, wherein the discharging power is dependent on the peak-to-peak voltage of the applied AC voltage, more particularly, the discharging power increases with the peak-to-peak voltage.

On the contrary, however, if the peak-to-peak voltage is too large, an unintended discharge may occur, such as spark discharge and a surface discharge. Therefore, it is difficult to increase the voltage very much.

In addition, the discharge wire of this discharger is easily contaminated with toner particles floating in the apparatus or fine paper dust produced from the paper (transfer material). These tend to produce the unintended discharge when the peak-to-peak voltage is increased, and therefore, it is not preferable.

On the other hand, in the image forming apparatus of this type, various materials including inorganic photoconductive material such as selenium, organic semiconductor material (OPC) and amorphous silicon semiconductor material are recently used as the photosensitive layer material for latent image formation in accordance with the purposes of use. Particularly, amorphous silicon material is recently used increasingly because it has a high surface hardness, a high mechanical strength, a high sensitivity and high durability without potential variation and crystallization due to repeated charge-exposure operations. Therefore, it matches the recent tendency toward the high speed in the apparatus of this type.

However, the durable voltage of the amorphous silicon is approximately 2 KV with the layer thickness of 25 microns, while that of OPC photosensitive member is not less than 5 KV with the approximate layer thickness of 20 microns (250 V/micron), and that of Se-Te and Se-As materials is not less than 3 KV with the layer thickness of approximately 50 microns (60 V/micron).

Therefore, the unintended discharge is easily produced when the amorphous silicon material is used in a high speed machine or the like wherein it is exposed to a high voltage corona discharge for a long period of time and wherein the intervals between maintenance operations are long with the result of a longer period during which the apparatus is operated with the contaminated discharging wire. Therefore, the liability of pinhole production and the resulting deterioration of the image are increased.

The amorphous silicon photosensitive member has a dielectric constant Es of approximately 10 which is larger than that of OPC and Se photosensitive members which are approximately 3 and 6, respectively. Therefore, the amount of corona discharge providing the same photosensitive member potential is larger with the result of requirement for a higher voltage of the corona discharge. This also promotes production of the unintended discharge.

It is possible that the above drawbacks are more or less reduced by increasing the thickness of the layer with the view to increasing the durable voltage. However, in the case of the amorphous silicon material, the production of the film thereof then becomes difficult, and the time required for the film production is increased. For those reasons, the increase of the layer thickness is not practical from the standpoint of the production and cost.

When the amorphous silicon material is used as the photosensitive member, the layer structure includes a surface protection layer, a photosensitive layer, a charge injection preventing layer and a substrate in the form of a laminated structure. In such a case, if an extreme amount of the electric charge is applied, the breakdown of the charge injection preventing layer first occurs, with the result of pinhole production over the entire photosensitive layer.

Accordingly, even if attempts are made to increase the discharge efficiency after the image transfer by increasing the applied voltage, it is difficult to increase the applied bias very much because of the problems of unintended discharge such as spark discharge and surface discharge and resulting damage to the photosensitive member.

Furthermore, the image forming machines of this type become recently widely used to such an extent that they are used by people having no knowledge of the internal structure or the image formation principle of the machine. From this standpoint, it is of course desirable that good separation can be effected with as low peak-to-peak voltage as possible.

SUMMARY OF THE INVENTION

Accordingly, it is a principal object of the present invention to provide an image forming apparatus wherein the good separating operation can be performed without increasing the peak-to-peak value of the voltage applied to the separating means for separating the transfer material from an image bearing member and without introduction of risk of production of the unintended discharge.

It is another object of the present invention to provide an image forming apparatus, wherein particularly when an amorphous silicon photosensitive member is used as the image bearing member, the production of pinholes and the production of the unintended discharge are prevented.

It is a further object of the present invention to provide an image forming apparatus wherein the deterioration of the image quality attributable to the unintended discharge and the pinhole production, is prevented.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
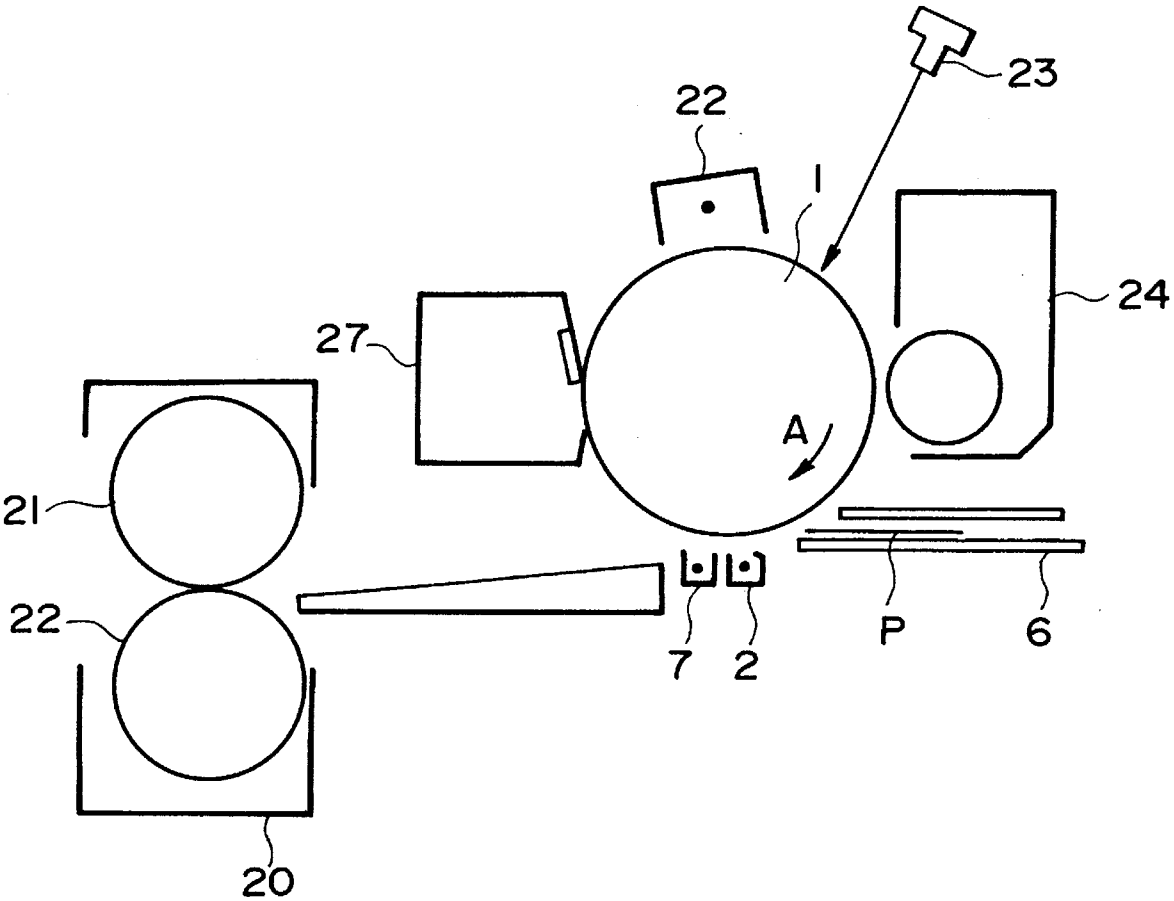
FIG. 1 is a sectional view of an image forming apparatus according to an embodiment of the present invention.

Referring to FIG. 1, there is shown an image forming apparatus such as a copying machine, in cross-section, according to an embodiment of the present invention. The apparatus comprises a photosensitive member 1 (image bearing member) in the form of a cylinder rotatable in the direction indicated by an arrow A. The photosensitive member 1 has a surface amorphous silicon photosensitive layer. Around the photosensitive member 1, there are provided a charger 22, information applying means 23, developing means 24, transfer charger 2, separation discharger 7 and cleaning device 27.

In operation, the surface of the photosensitive member 1 is first charged to a positive polarity by a charger 22 and then exposed to light modulated in accordance with image signal by the image information applying means (exposure means) 23 in the form of a laser scanner, for example, so that an electrostatic latent image is formed on the surface of the photosensitive member. The latent image is visualized with negatively charged toner particles by the developing device 24.

Figure 2:
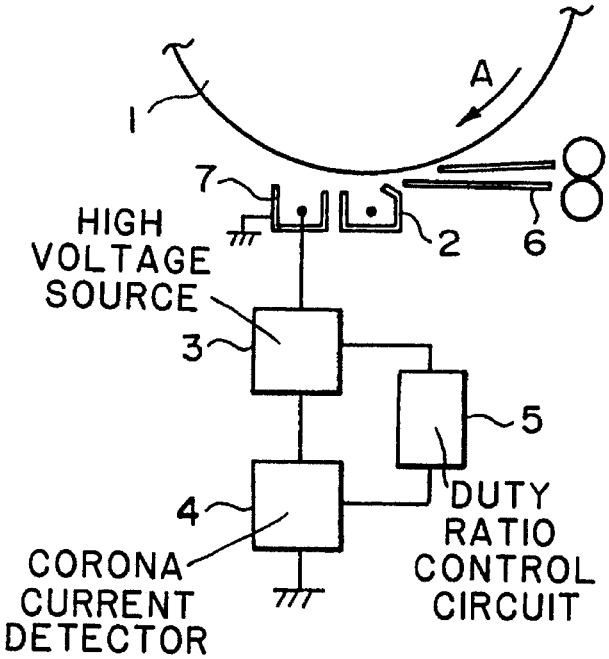
FIG. 2 is a sectional view of a major part of the image forming apparatus according to the embodiment of the present invention.

The toner image is formed of the negatively charged toner particles deposited to the positively charged portion of the surface of the photosensitive member 1. When such a toner image reaches an image transfer station having the image transfer charger 2, as shown in FIG. 2, a transfer material P reaches the transfer station in timed relation. At this time, the transfer charger 2 is supplied with a positive transfer bias to transfer the toner image onto the transfer material P. By the electric charge applied at this time, the transfer material tends to be electrostatically attracted to the photosensitive member 1.

When the transfer material reaches a separating station having a separation discharger 7, the separation discharger 7 neutralizes or discharge the electric charge of the transfer material to separate it from the photosensitive member 1. Thereafter, the transfer material is conveyed to the fixing device 20, as shown in FIG. 1, more particularly to between an image fixing roller 21 and a pressing roller 22 of the fixing device 20, where the toner image is fixed on the transfer material. On the other hand, after the image transfer, the residual toner on the photosensitive member 1 is removed by the cleaning device 27, to be prepared for the next image forming operation.

A discharge wire of the separation discharger 7 is electrically connected with, as shown in the Figure, a high voltage source 3 for producing an AC voltage which is deformed to provide flat positive and negative peaks, a corona current detecting circuit 4 and a duty ratio control circuit 5 for controlling a duty ratio of the AC current so as to provide a predetermined corona discharge current. Here, the alternating voltage means a voltage wherein the voltage level periodically changes with time.

Figure 3:
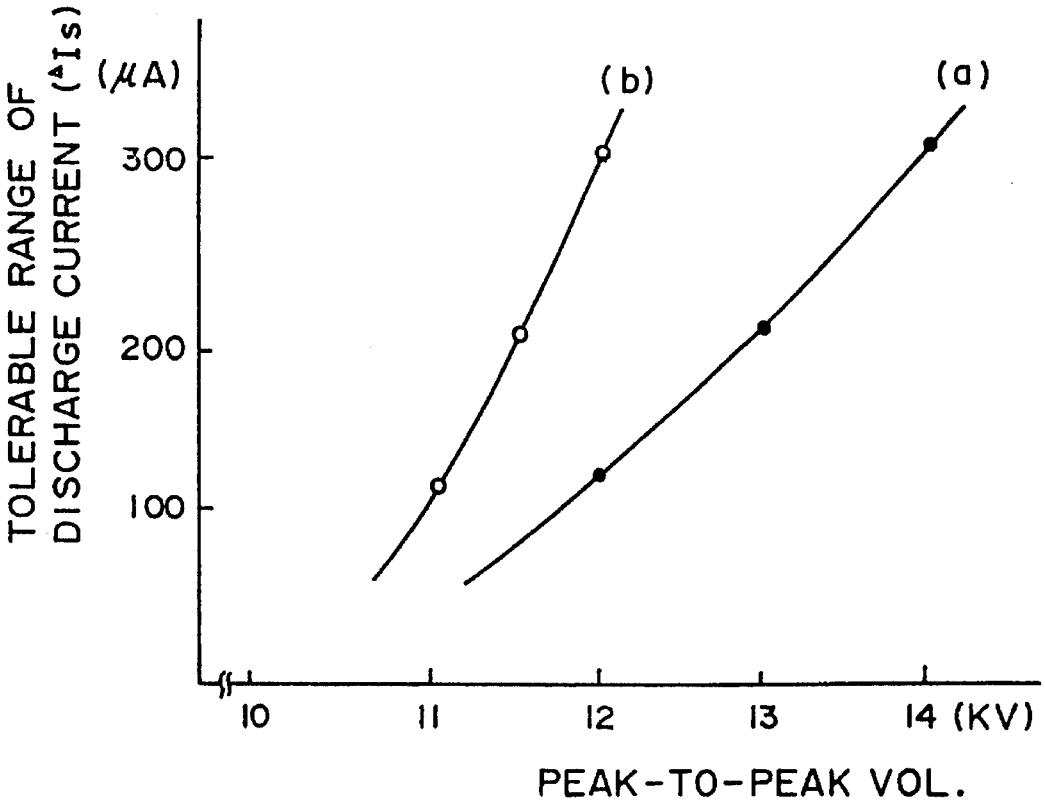
FIG. 3 is a graph showing a tolerable range of separation discharge current vs. a peak-to-peak voltage applied to the separation discharger in a conventional apparatus.

FIG. 3 is a graph comparing this embodiment (curve b) wherein the discharge current of the separation discharger is controlled and an example of prior art device (curve a) wherein a superposed AC (sine wave) and DC current is applied. In this graph, the abscissa represents a peak-to-peak value of the voltage applied to the separation discharger, and the ordinate represents a tolerable range ($\Delta Is$) (a difference between the positive and negative currents) of a DC component (Is) of the corona discharge current of the separation discharger. The tolerable range is defined as a range from a point where the transfer material having an image of white original (the transfer material without the toner image) is separated to a point where the transfer material having an image of a black original is separated without re-transfer which is a phenomenon of the toner image once transferred to the transfer material being transferred back to the photosensitive member.

As will be understood from the figure, in order to obtain the tolerable range ΔIs of 300 micro-ampere, the prior art system requires approximately 14 KV, whereas the embodiment of the present invention requires only approximately 12 KV. Thus, the present invention permits use of lower peak-to-peak voltage, so that the danger of the unintended discharge and the pinholes are reduced.

Figure 5:
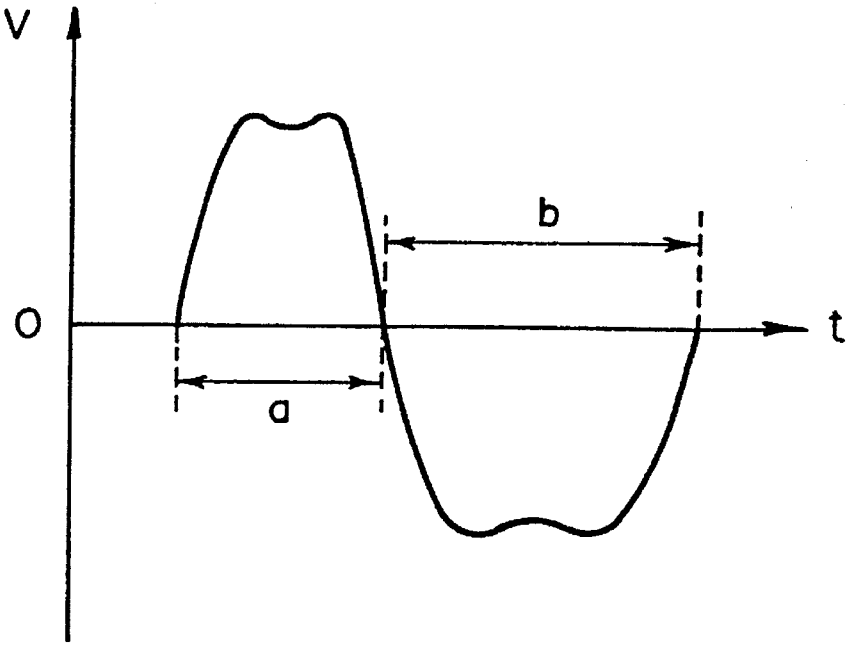
FIG. 5 is a graph showing a waveform of the separation discharger in the apparatus of FIG. 2.
Figure 4:
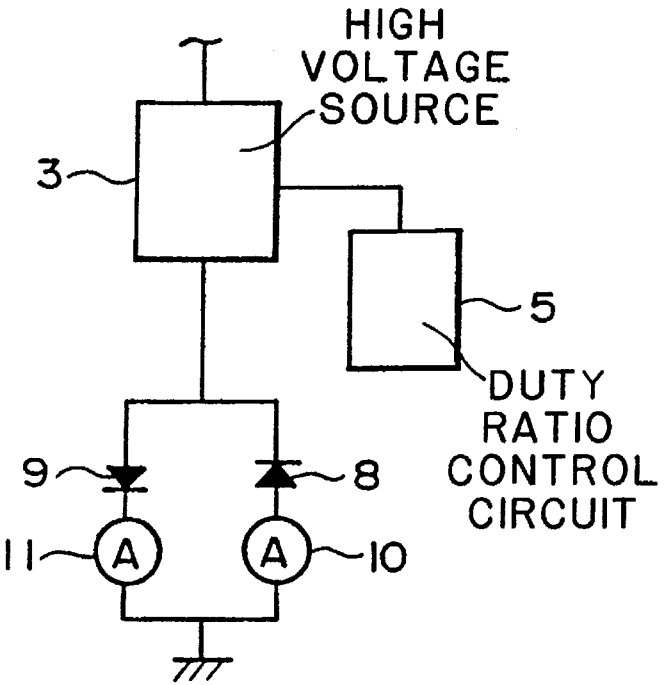
FIG. 4 is a current measuring circuit in the apparatus of FIG. 2.

In the FIG. 2 embodiment, the positive and negative component of the corona discharge current flow through ammeters 10 and 11 (FIG. 4), respectively and are detected thereby. The difference between the positive and negative components is controlled so as to be constant by a duty ratio control circuit 5 which controls the duty ratio (ratio of a:b in FIG. 5) of the waveform of the voltage applied to the discharger shown in FIG. 5.

Figure 6:
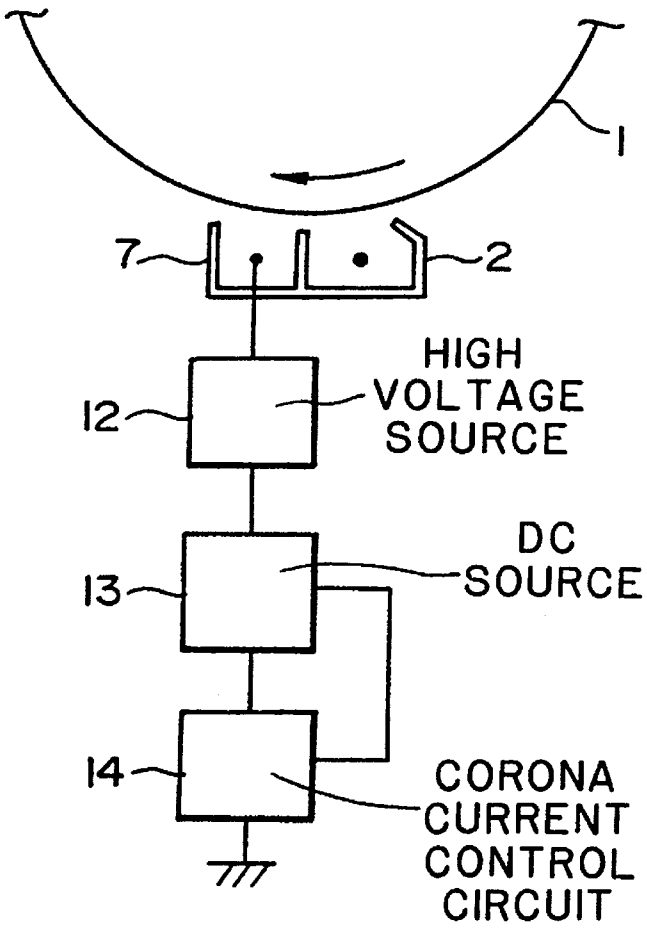
FIG. 6 is a sectional view of a major part of an apparatus according to another embodiment of the present invention.

Referring to FIG. 6, there is shown a device according to another embodiment of the present invention, wherein a separation discharger 7 is disposed downstream of a transfer charger 2 which is disposed adjacent to the amorphous silicon photosensitive member 1. The discharge wire of the separation discharger 7, similarly to FIG. 2, is connected to a high voltage source 12 which produces a deformed AC waveform having lowered peak values adjacent the positive and negative peaks, and the high voltage source 12 is connected to a DC source 13 providing a DC current having a polarity opposite to that of the transfer charger 2 to superpose the DC component. The corona current is controlled by a corona current control circuit 14. The corona current control circuit 14 controls the level of the DC component to control the difference current between the positive component and the negative component of the discharge current.

Figure 7:
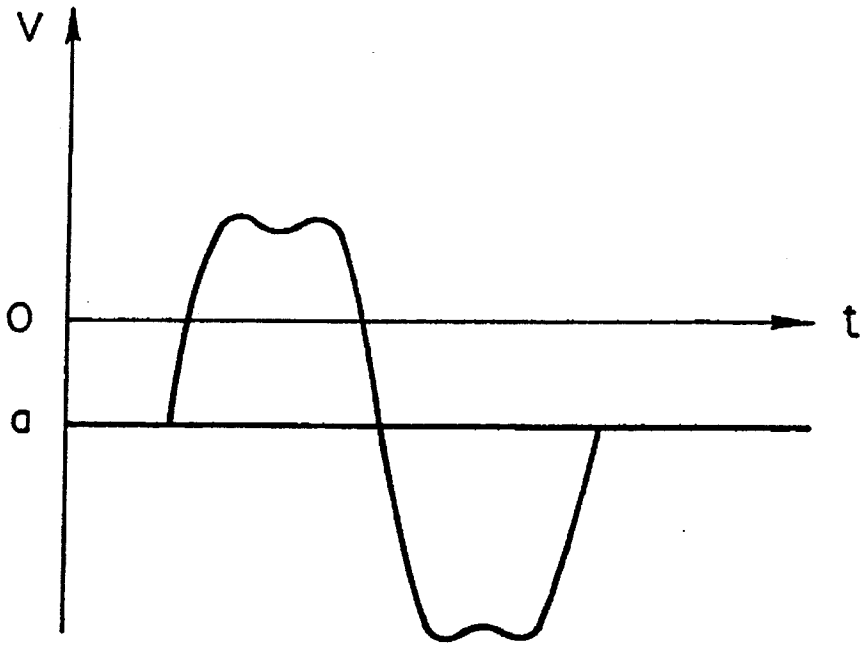
FIG. 7 is a graph showing a waveform of an output of the separation discharger of FIG. 6.

FIG. 7 shows a waveform of the voltage applied to the separation discharger 7 in this embodiment, wherein a reference a indicates a DC voltage level.

Figure 8:
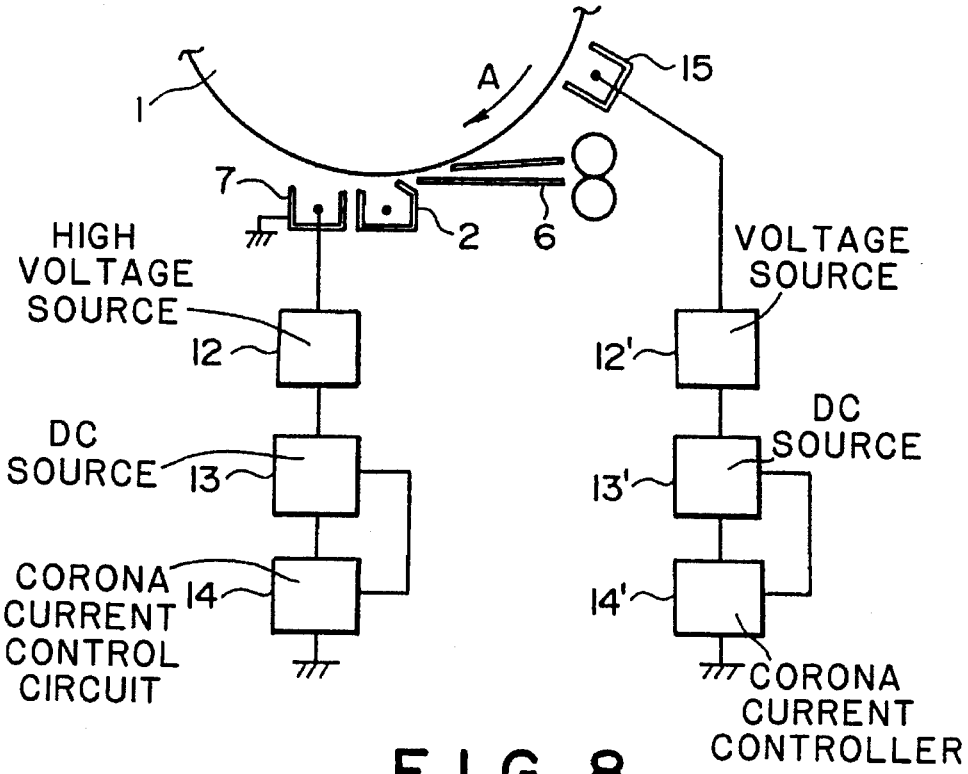
FIG. 8 is a sectional view of a major part of the apparatus according to a further embodiment of the present invention.

FIG. 8 shows a further embodiment wherein the present invention is applied to another means. In FIG. 8, the same references are applied to the elements having the functions corresponding to those of FIG. 6, and the detail description thereof are omitted for simplicity.

In this apparatus, in order to improve the image transfer efficiency, a post-charger 15 for applying corona discharge having the same polarity as the toner after development of the image is connected with a voltage source 12' for producing an AC voltage having deformed (lowered) peak values, with a DC source 13' superposed to the AC voltage to control the corona current and with a corona current control circuit 14' for controlling the corona current.

In the case of a high voltage AC source providing a sine wave form voltage, approximately 9.5 KV (peak-to-peak voltage) is required, whereas with the above described structure, the applied voltage by the source 12' can be lowered to approximately 8 KV with the same performance, and therefore, the danger of the unintended or abnormal discharge can be avoided.

Generally, the discharging power is dependent on a sum of the absolute values of the positive and negative components of the discharge current (total current), and the probability of the unintended discharge production increases with the peak-to-peak voltage level.

In the foregoing embodiments, the deformed wave having lowered peaks means that the peak-to-peak voltage is not more than 95% of that of a complete sine wave providing the same effective current (the same total current). Further preferably, it is an AC wave deformed closely to a rectangular wave, and has a peak-to-peak voltage which is not more than 90% of a complete sine wave with the same effective current. Such a waveform can be provided also by cutting the peaks of the sine wave by a limiter.

Figure 9:
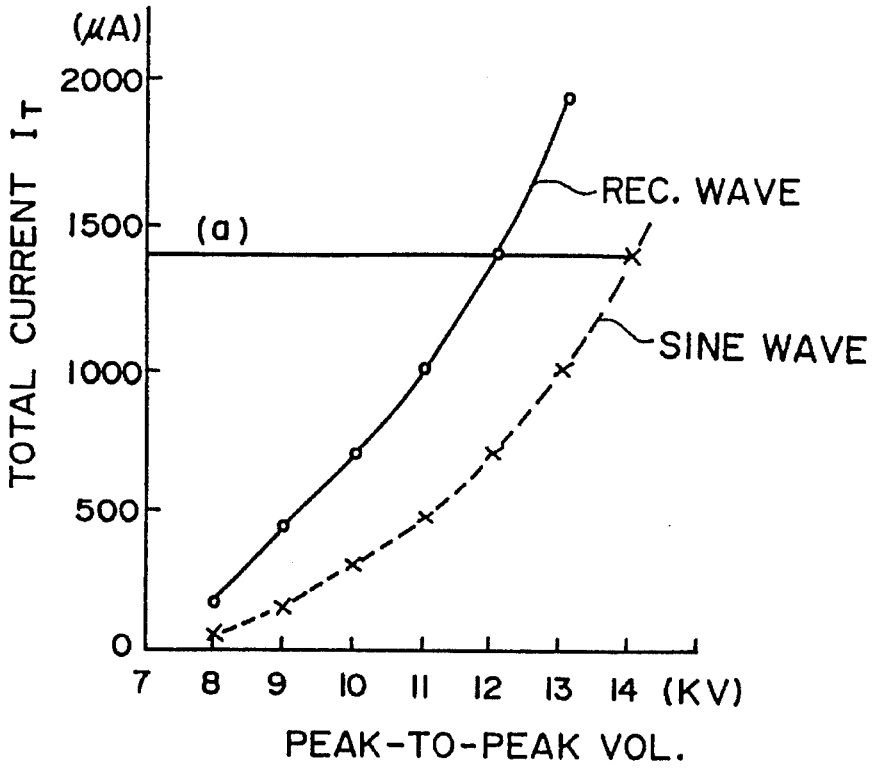
FIG. 9 is a graph showing a total current vs. a peak-to-peak voltage with a parameter of waveforms of the voltages applied to the separation discharger.

FIG. 9 is a graph showing a relationship between the total current and the peak-to-peak voltage level of the voltage applied to the separation discharger when the waveform thereof is sine and when it is rectangular. As will be understood, in order to provide the same discharging power, that is, the same total current, the peak-to-peak voltage can be lowered when the rectangular waveform is used. In the example shown, the required voltage of 14 KV with the sine wave is lowered to 12 KV when the rectangular wave is used. As will be understood, the rectangular wave can provide the desired discharging power with minimum peak-to-peak voltage. For this reason, the voltage source 12 of FIG. 6 desirably provides the rectangular waveform.

Figure 10:
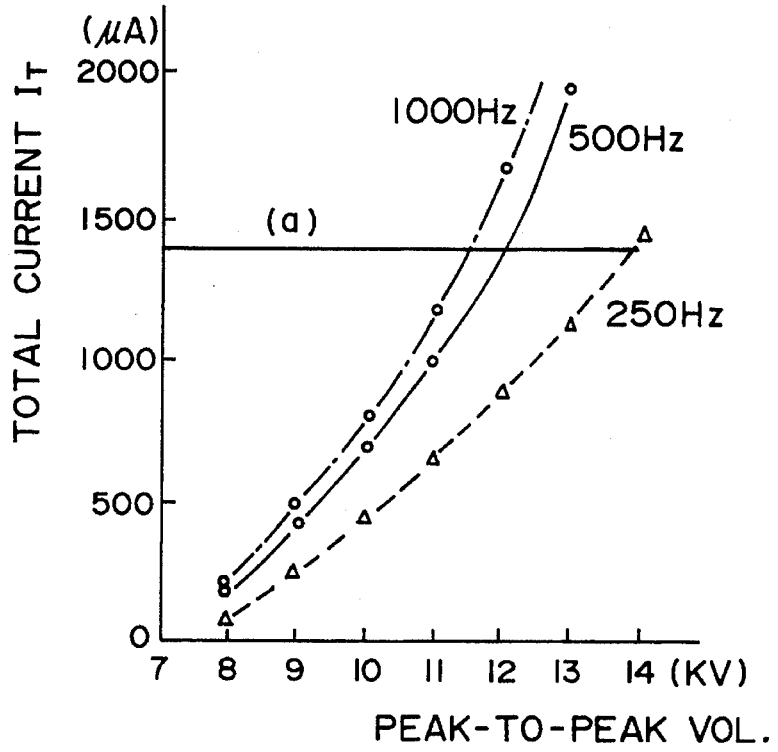
FIG. 10 is a graph showing a total current vs. a peak-to-peak voltage with a parameter of the frequencies of the voltage applied to the separation discharger.

FIG. 10 shows a relation between the frequency and the discharge current. The general tendency understood therefrom is that the discharge current increases with the frequency. However, as will be understood from the comparison between the increase rate from 250 Hz to 500 Hz and that from 500 Hz to 1000 Hz, the current increase rate reduces with the frequency. The reason is considered as follows. When the rising time is constant, the shoulders of the waveform become more round, that is, closer to the sine waveform, with the result of decrease of the discharge efficiency. In order to compensate this, the peak-to-peak voltage is required to be increased.

Figure 11:
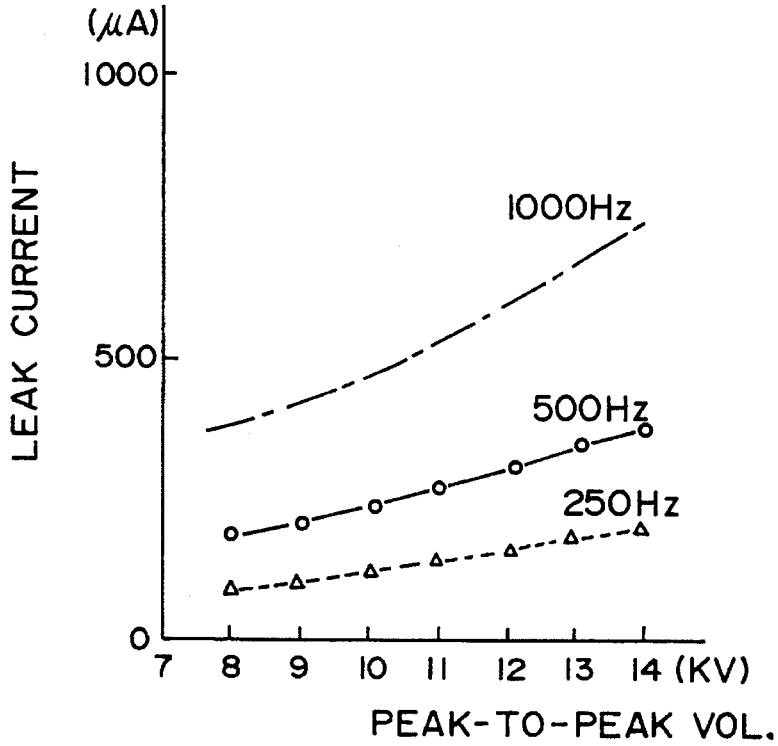
FIG. 11 is a graph showing a leakage current vs. a peak-to-peak voltage with a parameter of the frequencies of the voltage applied to the separation discharger.

With the increased frequency, the probability of high voltage leakage production is increased. This is illustrated in the graph of FIG. 11.

If the casing of the voltage source and the wires have electrostatic capacity C, the leakage current increases proportionally to $1/\omega C$ in the case of a high voltage AC having a frequency $f=\omega/2\pi$. Therefore, the leakage is doubled when 1000 Hz is used as compared with 500 Hz, and therefore, it is dangerous. In addition, the noise of a high voltage transformer is increased, to such an extent as to reach 1000 Hz.

In the case of the electrostatic separation, insufficient discharge results in insufficient separation of the transfer material with the possible result of jam, on the other hand, the excessive discharge promotes the re-transfer with the result of deteriorated image quality, as is known. In order to always perform good separating operation despite variation in the ambient conditions and difference or variation in the properties of the transfer material itself, it is desirable that a separation latitude ($I_{DC2}$-$I_{DC1}$) which is a range from the minimum current $I_{DC1}$ required for the separation to the current $I_{DC2}$ with which the image re-transfer starts, is as large as possible.

Figure 12:
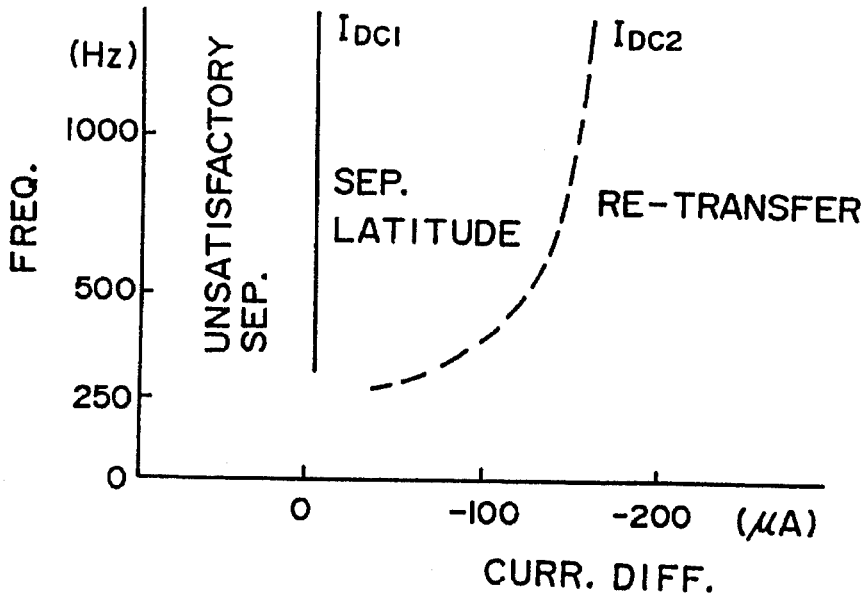
FIG. 12 is a graph illustrating a separation latitude in the apparatus of FIG. 6.

FIG. 12 shows a relation between the separation latitude and the frequency in a graph of the frequency vs. the current difference which is the difference between the positive component and negative component with the discharge current under the condition that the total current is constant, in the apparatus shown in FIG. 6. As will be understood, the re-transfer starting current increases with increase of the frequency, and the separation latitude becomes larger, but due to the deformation of the waveform, the latitude does not expand beyond a certain level of the frequency, and the latitude is too small under 250 Hz of the frequency.

In the case of a high frequency, the design preventing the high voltage leakage becomes difficult, whereas in the case of the low frequency, the problems of the bulkiness of the transformer arises.

From the above, it is preferable that in an image forming apparatus using an amorphous silicon photosensitive member wherein the electrostatic separation is performed, the applied AC voltage is in the form of a rectangular wave, and the frequency thereof is 250–1000 Hz, further preferably, 400–600 Hz.

Figure 13:
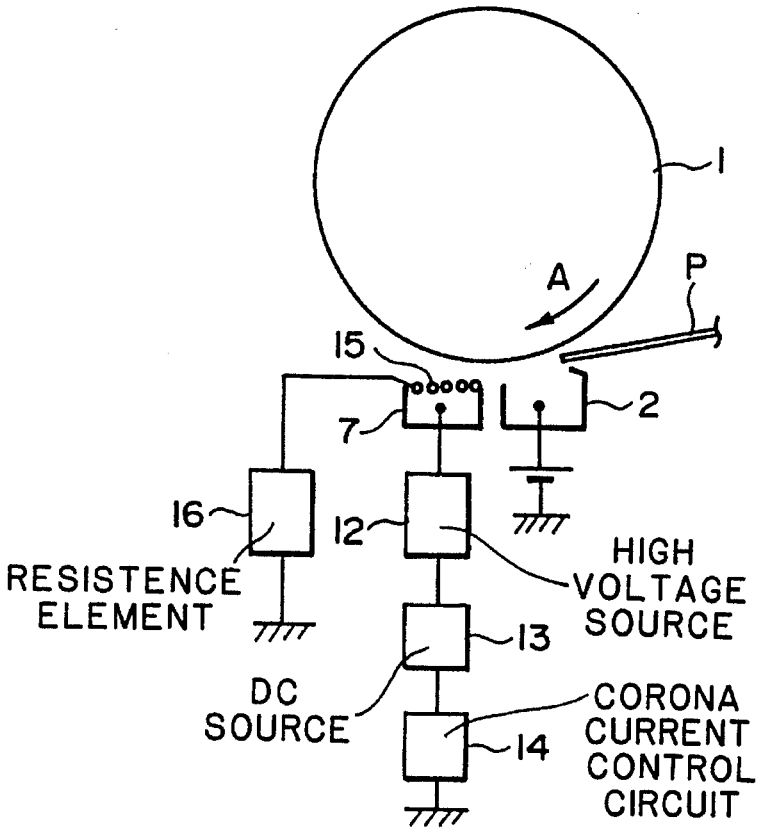
FIG. 13 is a sectional view of a major part of an image forming apparatus according to a further embodiment of the present invention.

FIG. 13 shows an apparatus according to a further embodiment of the present invention, wherein a grid 15 is disposed at the opening of the separation discharger 7 to the photosensitive member 1, and the grid 115 is connected with a resistance element 16 (or a non-linear element or bias voltage).

With this structure, the separation discharge is stabilized, and in addition, by controlling the discharge distribution, the balance between the separating performance and the re-transfer tendency can be changed. Furthermore, the self-bias effect of the element 16 is effective to cause the grid potential to follow the transfer material potential, by which the discharge efficiency can be increased.

Figure 14:
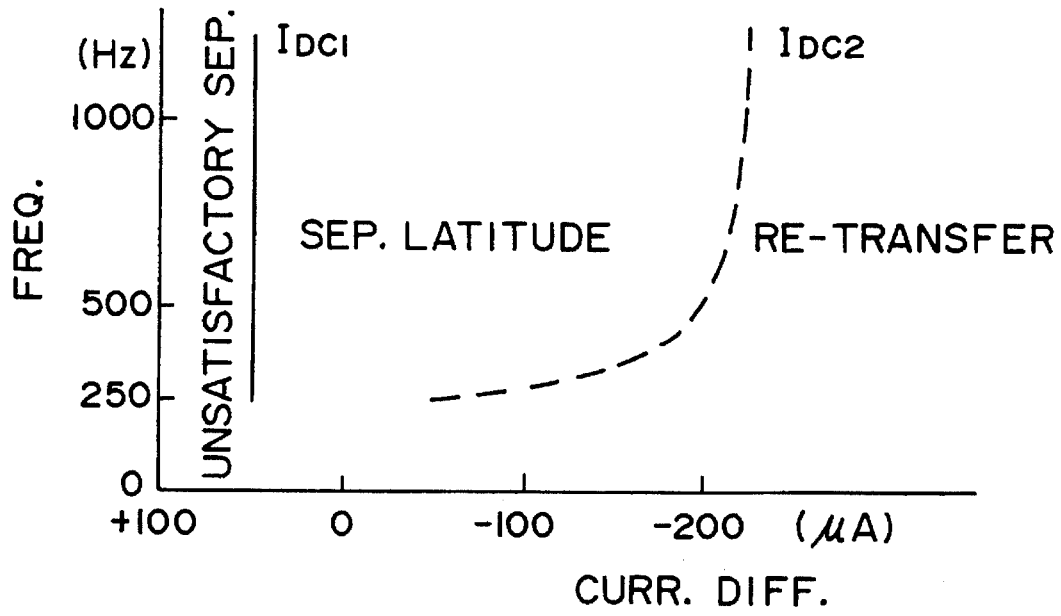
FIG. 14 is a graph illustrating a separation latitude in the apparatus of FIG. 13.

FIG. 14 shows the relation between the separation latitude and the frequency of the rectangular AC current applied to the separation discharger in this apparatus. As will be understood, the use of the grid is effective to further extend the separation latitude.

When the grid is used, a part of the discharge current flows to the grid, and in order to compensate this, the total current is required to increase. Then, the leakage by the surface discharge also increases with the result of the output being not stable adjacent 1000 Hz under a high humidity condition, but it has been confirmed that the instability does not appear below 600 Hz.

Figure 15:
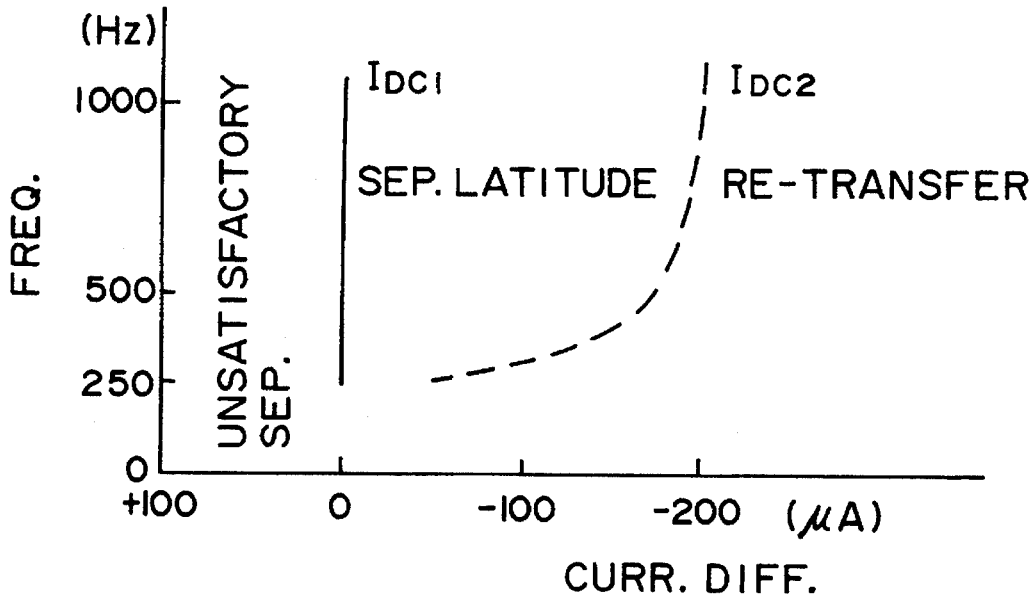
FIG. 15 is a graph illustrating a separation latitude in the apparatus of FIG. 8.

FIG. 15 shows the separation latitude and the frequency in the apparatus of FIG. 8. As will be understood, the image re-transfer can be reduced by using the post charger, so that the separation latitude can be expanded. In FIG. 8, the cost of the device is decreased by using the AC source 12 for the separation discharger 7 also as an AC source 12' for the post-charger 15.

In the foregoing embodiments, it has been found that the re-transfer is easily produced when the charging wire of the charger is contaminated with long term use, and this tendency is remarkable when the voltage source provides approximately 250 Hz frequency. The reason is considered as follows. When the frequency is low, the separation latitude is narrow as described hereinbefore, and the most of the materials deposited on the wire are insulative, and therefore, the discharge becomes more difficult. From the above, the frequency is preferably not less than 400 Hz in consideration of the durability and the separation latitude.

The above is summarized generally as follows.

| Frequency | Manufacturing Leakage waveform | Operation Separation latitude & wire contamination | Overall evaluation |
|---|---|---|---|
| 250 Hz ↓ | ○ | Δ | ○Δ |
| 500 Hz ↓ | ○ | ○ | ◎ |
| 1000 Hz | Δ | ○ | ○Δ |

◎: Excellent
○: Good
Δ: Fairly Good

From the above Table, the device is usable normally within the range of 250–1000 Hz. Preferably, however, 400–600 Hz with rectangular AC provides excellent electric discharge.

Figure 16:
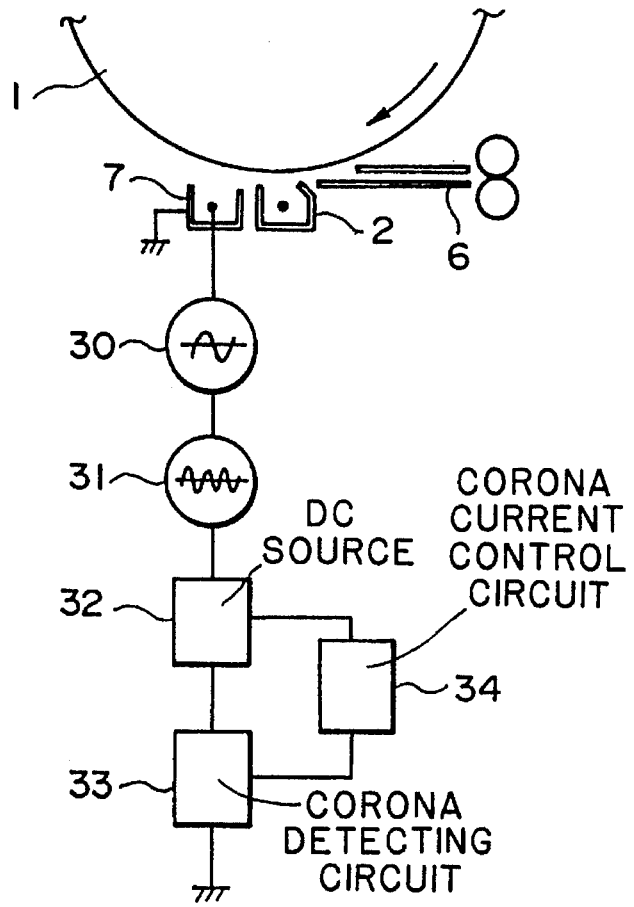
FIG. 16 is a sectional view of a major part of an apparatus according to a yet further embodiment of the present invention.

FIG. 16 shows a further embodiment, wherein the discharge wire of the separation discharger 7 is connected with a first sine wave high voltage source 30, a second sine wave high voltage source 31 and a DC source 32 in series. In response to an output of a corona current detecting circuit 33, the DC voltage source is driven by a corona current control circuit 34 to control the amount of corona discharge. The frequency of the second source 31 is three times that of the first source 30, and the phase synchronization therebetween is such that when the voltage by the first source 30 is 0 V, the voltage by the second source 31 is also 0 V. By this, the voltage waveform of the former decreases the peak levels of the voltage waveform of the latter by superposition of them.

Figure 17:
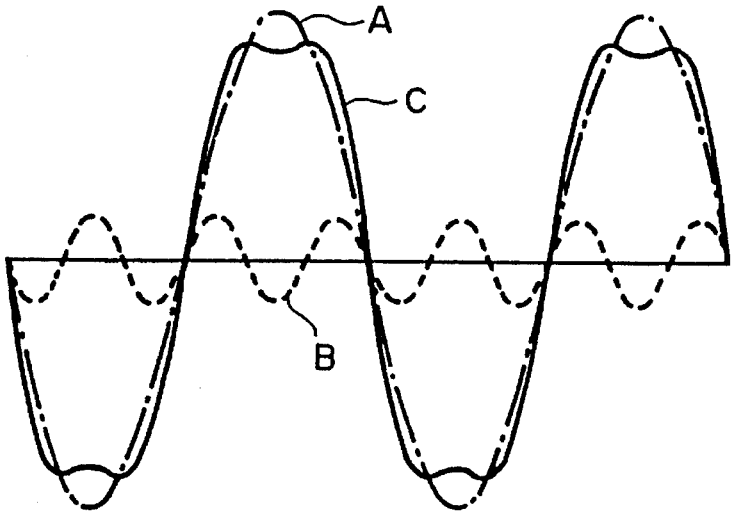
FIG. 17 is a graph showing a waveform of a voltage applied to the separation discharger.

FIG. 17 shows the voltage waveform of the AC component of this device, wherein the chain line A designates a sine waveform provided by the voltage source 30 having the peak-to-peak voltage of 13.6 KV and the frequency of 500 Hz, and the broken line B designates a sine waveform by the voltage source 31 having the peak-to-peak voltage of 2.4 KV and the frequency of 1500 Hz.

The relation between the voltage A and the voltage B is preferably such that the voltage B is 0.1–0.33, preferably 0.15–0.25 times the voltage A in the peak-to-peak voltage in this embodiment, it is 0.18 times. The frequency of the voltage B is three times that of the voltage A, and a peak of a polarity of the voltage A is in accord with a peak of the opposite polarity of the voltage B so as to lower the level of the combined peak.

The solid line C designates a combined waveform of the voltages A and B, wherein the peak-to-peak voltage is 11.8 kV, and the frequency is 500 Hz.

Describing the function of the applied voltage, the corona current when the separation discharger 7 is supplied only with the voltage A having the peak-to-peak voltage of 13.6 KV which is conventional, is 550 micro-ampere in the sum of the positive and negative components, whereas when the voltage C having the peak-to-peak voltage 11.8 KV is applied, it is 525 micro-ampere which means substantially equivalent corona current. It is understood that the current corresponds to the peak-to-peak voltage of 13.4 KV in the voltage A, and it corresponds to the peak-to-peak voltage which is lower than that by 1.6 KV in the voltage C.

The discharge starting voltage of the separation discharger 7 was approximately ±3.5 KV in the positive and negative sides, the discharge electric field in the voltage wave A is (13.4/2)–3.5=3.2 KV at the positive side, whereas that of the voltage C is (11.8/2)–3.5=2.4 KV. Therefore, the discharge electric field in the case of the waveform C is only 75% of that of the waveform A voltage.

Next, the investigations were made as to the separating performance and the production of the image re-transfer. The voltage having the waveform A and having the peak-to-peak voltage of 13.4 KV and the voltage having the waveform C and having the peak-to-peak voltage 11.8 KV were applied, and the ratio of the positive and negative components of the corona discharge was changed by the DC source 32, namely, the current difference was changed.

In the case of the waveform A, the separation took place at the negative side from −10 micro-ampere, and the image re-transfer occurred at the negative side from −100 micro-ampere, and the tolerable range was found to be −10—100 micro-ampere, namely, 90 micro-ampere.

In the case of the waveform C, the range was 0—120 micro-ampere, and the tolerable range was 120 micro-ampere. As will be understood, the range providing the good separation can be expanded.

Figure 18:
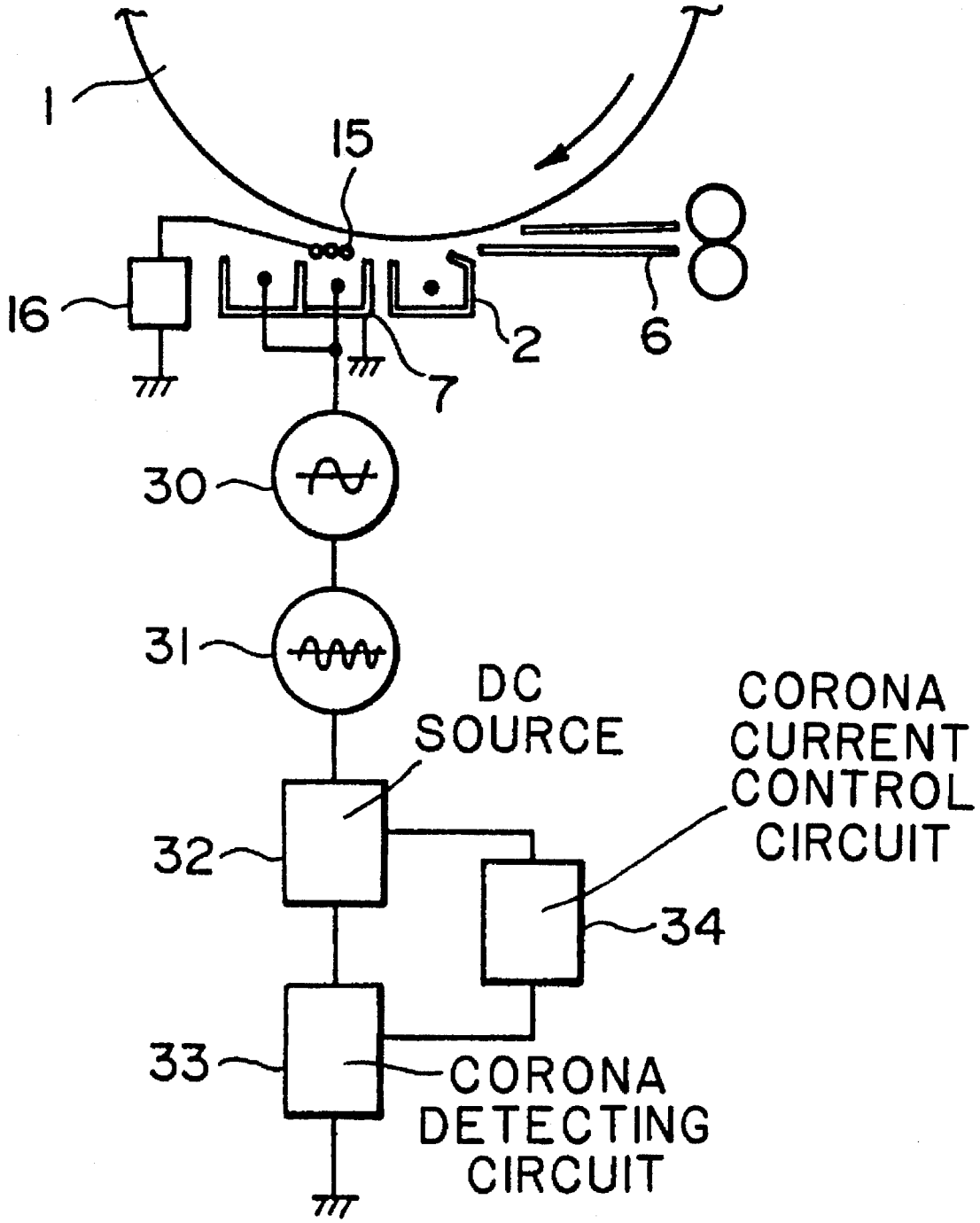
FIG. 18 is a sectional view of a major part of an apparatus according to a further embodiment of the present invention.

FIG. 18 shows a further embodiment wherein the grid electrode is used in the separation discharger. The same reference numerals are assigned to the element having the corresponding functions as in the foregoing embodiments, and therefore, the description thereof is omitted for simplicity.

In this embodiment, two separation dischargers are used, and the grid electrode 115 is provided only for the downstream side of that one of the separation dischargers which is near the transfer charger with respect to the movement direction of the transfer material. The grid electrode 15 is connected to a resistance element indicated by a reference numeral 16. In place of the resistance element, a bias voltage or a non-linear element is usable.

In the apparatus of FIG. 18, the waveform applied to the discharge wire of the separation discharger corresponds to the waveform C of FIG. 17. When this is compared with the waveform A in the discharge current and the re-transfer, the sum of the negative and positive components of the corona discharge current is 1080 micro-ampere when the peak-to-peak to-peak voltage of the voltage is 13.4 KV, whereas the sum is 1040 micro-ampere which is equivalent is provided with the peak-to-peak voltage of 11.8 KV in the case of the waveform C.

The tolerable range for the re-transfer in the case of the waveform A is +30—150 micro-ampere, and the tolerable range is 180 micro-ampere, whereas in the case of the waveform C, the range is +50—180 micro-ampere, namely, as large as 230 micro-ampere.

As will be understood, the performance with respect to the image re-transfer is improved in the separating device using the grid electrode. As a problem with use of the grid electrode, the grid electrode is contaminated with the result that the unintended discharge can occur between the discharge wire of the discharger and the grid electrode. In the case of the waveform A, the spark (unintended) discharge occurred after approximately 50,000 sheets were processed when the peak-to-peak voltage was 13.4 KV. On the other hand, in the case of the waveform C, the spark discharge did not occur even after approximately 100,000 sheets were processed, when the peak-to-peak voltage was 11.8 KV.

In the foregoing embodiments described in conjunction with FIGS. 16 and 18, two voltage waveforms are applied, one by the sine voltage source 30 and the other by the second sine wave voltage source 31 providing the frequency which is three times that of the source 30. This is not limiting, and it is suffice if a sine wave AC voltage having a frequency of f and one or more of sine wave AC voltages having lowest frequencies of mf (m=2n+1; n is a positive integer) are superposed.

FIG. 18 shows an example wherein three sine wave voltages are superposed. In this example, a first waveform having the frequency of f, a second waveform having the frequency of 3f and a third waveform having the frequency of 5f are superposed. The second and third waveforms have the peak-to-peak voltages which are 0.24 and 0.07 times that of the first waveform, respectively. The superposed waveform is as shown in FIG. 18. In this figure, the first, second and third waveforms are designated by references D, E and F, and the superposed waveform is indicated by a reference G.

When the bias voltage having the combined waveform is applied to the device shown in FIG. 16 or 18, the sum of the positive and negative components of the corona discharge current is larger than when the two sine waveforms are superposed as in FIGS. 16 and 18 embodiments, under the condition that the peak-to-peak voltage is the same. Therefore, the better separation can be effected.

Figure 19:
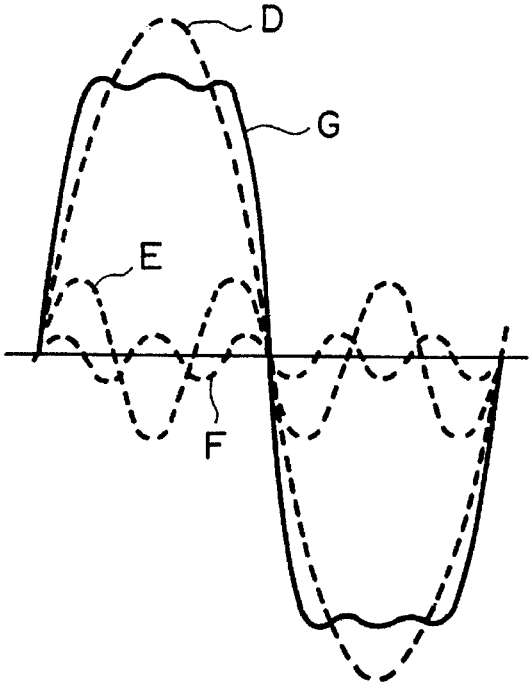
FIGS. 19 and 20 illustrate combination of three sine wave voltage.
Figure 20:
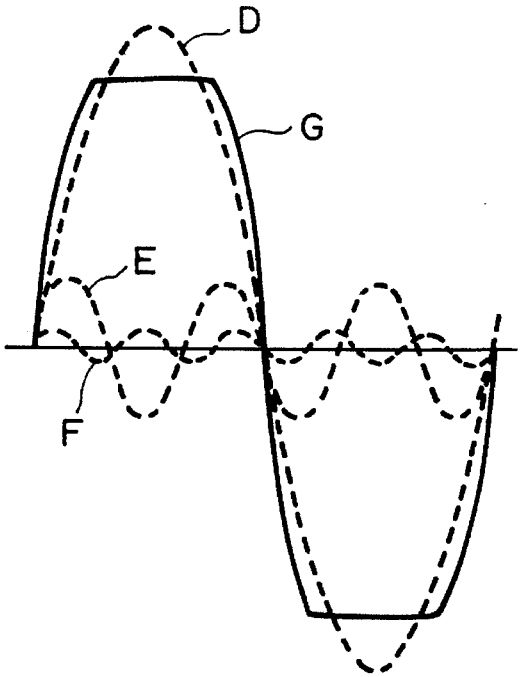

FIG. 19 shows an example wherein the peak-to-peak voltages of the second waveform and the third waveform are 0.22 and 0.05 times the first waveform. The superposed waveform is as indicated by a reference G. The peak of the applied bias can be made further flatter as shown in this Figure.

As described, the waveform becomes better by superposing higher order frequency wave or waves.

In the foregoing, the description has been made in the case where the amorphous silicon photosensitive member is used, but the present invention is not limited to this, and the present invention is effectively applicable with the photosensitive member of another material such as OPC or selenium.

In the foregoing embodiments, both of the positive side peak and the negative side peak are deformed. However, only one side peak may be deformed. For example, in the case of the amorphous silicon photosensitive member, the charging polarity is positive, and therefore, the photosensitive member is more easily deteriorated when it is subjected to the positive polarity which is the same as the charging property thereof. In consideration of these, it is effective to deform the peak at such a side as is the same as the polarity property of the photosensitive member.

As described in the foregoing, according to the present invention, the peak-to-peak voltage of an AC voltage applied to separation means for separating a transfer material from an image bearing member, can be decreased, and therefore, an intended discharge is avoided, and the transfer material separating operation can be stabilized, particularly in an image forming apparatus using an amorphous silicon photosensitive member. The deterioration and damage of the photosensitive member attributable to the unintended discharge can be prevented, and therefore, the quality of the image can be maintained.

Further, a transfer material separating device can be provided which easily matches the needs for the high speed image forming apparatus and for a small size image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

image forming means for forming an image on a surface of said image bearing member;

transfer means for transferring an image formed on the surface of the image bearing member by said image forming means onto a transfer material;

separating means for electrostatically separating the transfer material from said image bearing member after the image is transferred by said transferring means; and means for supplying to said separating means an electric power having a periodic voltage of a periodically changing continuous waveform, the waveform being a generally sinusoidal waveform that is flattened in a neighborhood of a peak of the periodic voltage, a peak-to-peak voltage level of the periodic voltage being not higher than 95% of a peak-to-peak voltage level of an AC voltage having a complete sinusoidal waveform having the same effective current.

2. An apparatus according to claim 1, wherein the periodic voltage has a frequency of 250–1000 Hz.

3. An apparatus according to claim 2, wherein the periodic voltage has a frequency of 400–600 Hz.

4. An apparatus according to claim 1, wherein the periodic voltage has a peak-to-peak voltage that is not more than 90% of an AC voltage having a complete sinusoidal waveform having the same effective current.

5. An apparatus according to claim 1, wherein said separating means comprises a corona discharger.

6. An apparatus according to claim 5, wherein said separating means comprises a grid electrode for controlling an amount of discharge by said separating means.

7. An apparatus according to claim 1, wherein said periodic voltage has a DC component and said DC component has a polarity opposite to a polarity of a voltage applied to said transfer means.

8. An apparatus according to claim 1, further comprising a duty ratio control means for controlling a duty ratio of the periodic voltage applied to said separating means.

9. An apparatus according to claim 1, wherein said image forming means comprises latent image forming means for forming a latent image on the surface of said image bearing member and developing means for developing the latent image with toner.

10. An apparatus according to claim 9, further comprising charging means, disposed between said developing means and said transfer means, for applying an electric charge having the same polarity as the toner to the surface of said image bearing member.

11. An apparatus according to claim 10, wherein said charging means is supplied with a periodic voltage having a rectangular waveform.

12. An apparatus according to claim 1, further comprising control means for controlling the electric power supplying means to provide a constant current difference between a positive component of the periodic voltage and a negative component of the periodic voltage.

13. An apparatus according to claim 1, wherein said image bearing member includes an amorphous photosensitive layer.

14. An image forming apparatus, comprising:

a movable image bearing member having an amorphous silicon photosensitive layer;

transfer means for transferring the image formed on the surface of said image bearing member by a image forming means onto a transfer material; and separating means for electrostatically separating the transfer material from said image bearing member after the image is transferred by said image transfer means, wherein said separating means is supplied with a voltage which periodically changes and has a waveform provided by superposing a first sine waveform and a second sine waveform having a frequency which is three times that of the first sine waveform so that a peak level of the first sine waveform is lowered by the second sine waveform.

15. An apparatus according to claim 14, wherein said separating means comprises a corona discharger.

16. An apparatus according to claim 14, wherein the second sine waveform has a peak-to-peak voltage which is 1/10–1/3 a peak-to-peak voltage of the first sine waveform.

17. An apparatus according to claim 14, wherein said separating means is further supplied with a DC voltage having a polarity opposite to a polarity of a voltage applied to said transfer means.

18. An apparatus according to claim 14, wherein said separating means comprises a grid electrode for controlling discharge current of said separating means.

19. An image forming apparatus, comprising:

a movable image bearing member having an amorphous silicon photosensitive layer;

image forming means for forming an image on a surface of said image bearing member;

transfer means for transferring the image formed on the surface of said image bearing member by said image forming means onto a transfer material; and separating means for electrostatically separating the transfer material from said image bearing member after the image is transferred by said image transfer means, wherein said separating means is supplied with a voltage which periodically changes and has a waveform provided by superposing a sine waveform having a frequency f and at least n sine waveforms having respective frequencies of mf so as to lower a peak level of the sine waveform having the frequency of f, where m is 2n+1, and n is a positive integer.

20. An apparatus according to claim 19, wherein said separating means comprises a corona discharger.

21. An apparatus according to claim 20, wherein said separating means comprises a grid electrode for controlling discharge current of said separating means.

22. An apparatus according to claim 19, wherein a secondary waveform has a peak-to-peak voltage which is 1/10–1/3 a peak-to-peak voltage of a first sine waveform.

23. An apparatus according to claim 19, wherein said separating means is further supplied with a DC voltage having a polarity opposite to a polarity of a voltage applied to said transfer means.

24. An image forming apparatus, comprising:

a movable image bearing member;

image forming means for forming an image on a surface of said image bearing member;

transfer means for transferring an image formed on the surface of said image bearing member onto a transfer material; and separating means for electrostatically separating the transfer material from said image bearing member after an image is transferred by said image transfer means, wherein said separating means is supplied with a voltage which periodically changes and has a waveform provided by superposing a sine waveform having a frequency f and a sine waveform having a frequency mf, so as to lower a peak level of the sine waveform having the frequency f, where m is 2n+1, and n is a positive integer.

25. An apparatus according to claim 24, wherein said voltage has a waveform provided by superposing a first sine waveform and a second sine waveform having a frequency which is three times that of the first sine waveform so that a peak level of the first sine waveform is lowered by the second sine waveform.

26. An apparatus according to claim 24, wherein said separating means comprises a corona discharger.

27. An apparatus according to claim 26, wherein said separating means comprises a grid electrode for controlling discharge current of said separating means.

28. An apparatus according to claim 24, wherein a secondary sine waveform has a peak-to-peak voltage which is 1/10–1/3 a peak-to-peak voltage of a first sine waveform.

29. An apparatus according to claim 24, wherein said separating means is further supplied with a DC voltage having a polarity opposite to a polarity of a voltage applied to said transfer means.

30. An apparatus according to claim 24, further comprising control means for controlling the electric power supplying means to provide a constant current difference between a positive component of the periodic voltage and a negative component of the periodic voltage.

* * * * *

UNITED STATES PATENT AND TRADEMARK OFFICE

CERTIFICATE OF CORRECTION

PATENT NO. : 5,526,106

DATED : June 11, 1996

INVENTOR(S) : Toru KATSUMI, et al.

It is certified that error appears in the above-indentified patent and that said Letters Patent is hereby corrected as shown below:

SHEET 7 OF THE DRAWINGS - FIGURE 13:

"RESISTENCE" should read --RESISTANCE--.

COLUMN 4:

Line 31, "discharge" should read --discharges--.

COLUMN 5:

Line 39, "description" should read --descriptions--
.

COLUMN 9:

Line 10, "electrode 15" should read --electrode 115--; and,
Line 44, "suffice" should read --sufficient--.

COLUMN 11:

Line 38, "a" should read --an--.

Signed and Sealed this

Eighth Day of October, 1996

Bruce Lehman

*Attest:*

BRUCE LEHMAN

*Attesting Officer*

*Commissioner of Patents and Trademarks*

--